United States Patent [19]

Guier

[11] 4,413,387

[45] Nov. 8, 1983

[54] DRILLING APPARATUS

[76] Inventor: William Guier, 3100 E. 71st St., Tulsa, Okla. 74136

[21] Appl. No.: 266,439

[22] Filed: May 22, 1981

[51] Int. Cl.[3] ..... E12B 3/00

[52] U.S. Cl. ..... 188/67; 175/422

[58] Field of Search ..... 24/263 DA, 263 D, 263 DH, 24/263 DC, 249 DP, 263 DQ; 166/77.5; 173/164

[56] References Cited

U.S. PATENT DOCUMENTS

| | | | |
|---|---|---|---|
| 1,502,628 | 7/1924 | Hanna | 24/263 D |
| 1,844,378 | 2/1932 | Campbell | 24/249 DP |
| 2,217,072 | 10/1940 | Nixon | 24/249 DP |
| 2,231,923 | 2/1941 | Koen | 24/263 DA |
| 2,257,120 | 9/1941 | Lundeen | 24/249 DP |
| 2,633,333 | 3/1953 | Storm | 24/263 DQ |
| 2,803,434 | 8/1957 | Heinish | 166/77.5 |
| 3,309,130 | 3/1967 | Arrowood | 24/249 DP |
| 3,514,822 | 6/1970 | Guier | 24/263 DA |
| 3,961,399 | 6/1976 | Boyadjieff | 24/263 DA |
| 3,980,143 | 9/1976 | Swartz et al. | 166/77.5 |
| 4,030,542 | 6/1977 | Poe et al. | 24/249 DP |

FOREIGN PATENT DOCUMENTS

| | | | |
|---|---|---|---|
| 771274 | 3/1957 | United Kingdom | 24/263 DA |

*Primary Examiner*—Paul J. Hirsch

[57] ABSTRACT

The structure disclosed is that part of a complete drilling apparatus which suspends the string of drill pipe in the well from the derrick floor. The apparatus is disclosed as automatically actuated to grip the pipe below the box on its upper end while either awaiting attachment to a hoist apparatus for tripping out of the well or makeup to a pipe stand in the drilling sequence.

1 Claim, 3 Drawing Figures

DRILLING APPARATUS

TECHNICAL FIELD

The present invention relates to a drilling tool which is a part of a complete apparatus for rotary drilling with which the drill string is suspended in a fixed relation to the floor of the derrick. More particularly, the invention relates to a tool which will be termed a "spider", which engages a drill string beneath the upper box of a drill string stand from which to suspend the drill string as it extends down into the well.

BACKGROUND ART

I have created a family of related inventions at least one of which is disclosed in U.S. Pat. No. 3,857,450 issued December, 1974. It has been my purpose to systematically evolve a series of revolutionary well tools for the manipulation of drill pipe to propel the rotary drilling art out of its developmental stagnation in which it has been mired from the early part of this century. Every element of the conventional drilling tools has been carefully studied by myself and their consolidations, replacements and improvements have been scattered throughout the complete range of these improved tools as used in the drilling operation.

The lowly slip structures have not escaped by analysis. I have provided a carriage structure for these manually manipulated slip structures to facilitate their movement on the rig floor. The placing of the slips has been shifted and their structure has been modified in my striving toward ultimate simplicity, speed and flexibility in the dangerous handling of drill pipe as it has been made up into drill strings and tripped in and out of the well.

The concept of automation is the lode star in drill pipe handling. However, I have made my improvements as a compatible extension of the prior art. In the present instance, it is my desire to automate the entire slip structure as the upper end of the drill string is brought up through the opening in the floor of the drill rig for the standard rotary table. The problem I face is the provision of what I call a "spider" structure which can be automated to grip and release the drill string as it is brought up from the well, but with the spider mounted at the existing aperture in the rig floor.

Some form of adapter plates must be provided to fit the standard openings in regular floors where the removed rotary table was located. These plates, or plate, must be adapted to support the improved automated spider structure which I provide. The spider structure must include the concept of a pair of jaws closed beneath the shoulder of the box on the upper end of the top drill string stand. At the same time, the two jaws of the spider must be manually or automatically actuated to open and release the drill string as required in the drilling and tripping sequences.

DECLARATION OF THE INVENTION

The present invention provides a two-part spider structure mounted on a base which fits an existing rotary table station of a standard drilling rig floor. The two parts of the spider are hinged to open and close about the drill string stand at the time required in the drilling and tripping sequences of the drilling operation.

The invention further contemplates the employment of one or more cover plates for the standard aperture through the floor of a drilling rig on which the spider is mounted. The plates are concentrically arranged and keyed to each other to form the spider mount over the standard slip bowl but function in lieu of the manually placed spiders commonly arranged in a slip bowl.

BEST MODE OF PRACTICING THE INVENTION

As the three drawings are of the same embodiment of the invention, numerals will be repeated and if employed in one of the figures, the inference is to be drawn that the same structure in another of the figures is to be identified by the same number. Many of the structures appear on all three of the figures. However, the structure is quite simple and no confusion should be experienced in considering all three figures together.

Figure 1:
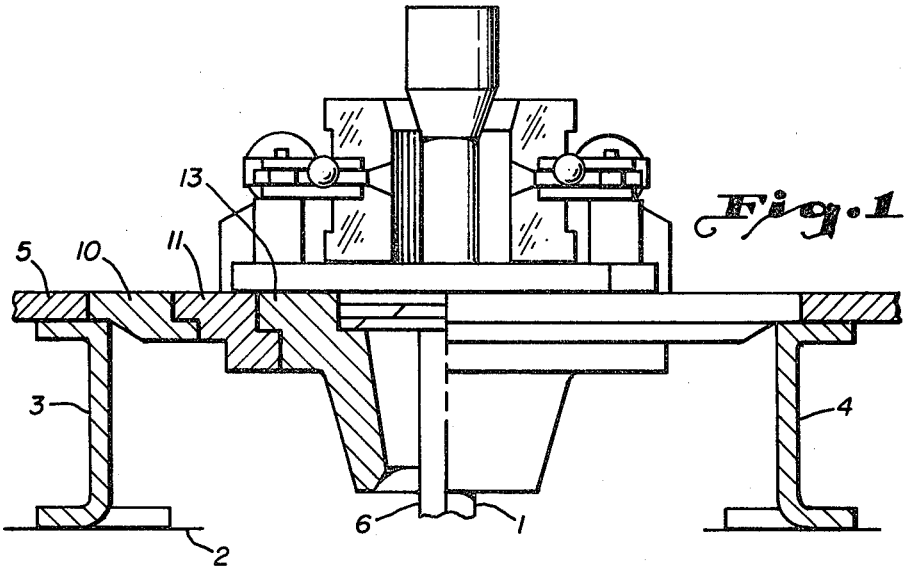
FIG. 1 is a sectional elevation of the lower part of the drilling structure embodying the present invention.

In FIG. 1, the embodying structure is grouped around bore hole 1 which is the reason d'etre for the structure shown in association with it. The ground level is 2. The drill string is in the bore hole with structures 3 and 4 supporting the embodiment of the invention. The supporting structures may take many forms and be constructed of many different materials, but obviously they directly interface with the ground 2 to give firm, stable support to the apparatus of the drilling structure.

The drilling structure base is embodied in floor 5. Here again, the materials and form of materials for this floor are varied. They obviously must provide a flat surface on the upper part of the floor 5 strong enough to support the tremendous weight of the drilling tools mounted thereon.

The dramatic height of the drilling rig derrick, or equivalent, is not disclosed. The derrick may take many forms which have no direct relationship to the present structure embodying the invention. We see in FIG. 1 a simple floor 5 with an aperture in which is mounted plates to support the structure through which will pass the drill string 6 and periodically lock the drill string in relation to this floor as required in the sequences of drilling and tripping.

The rotary table has been a well known feature of drilling tools mounted in the floor aperture. Although my concepts embodied in drilling apparatus do not utilize the rotary table in its original function, my present invention can be formed to utilize this rotary table as a mount. More simply, my new spider can be mounted upon the old rotary table, engaging the drill string 6 below the box on the upper end of its highest stand.

Figure 2:
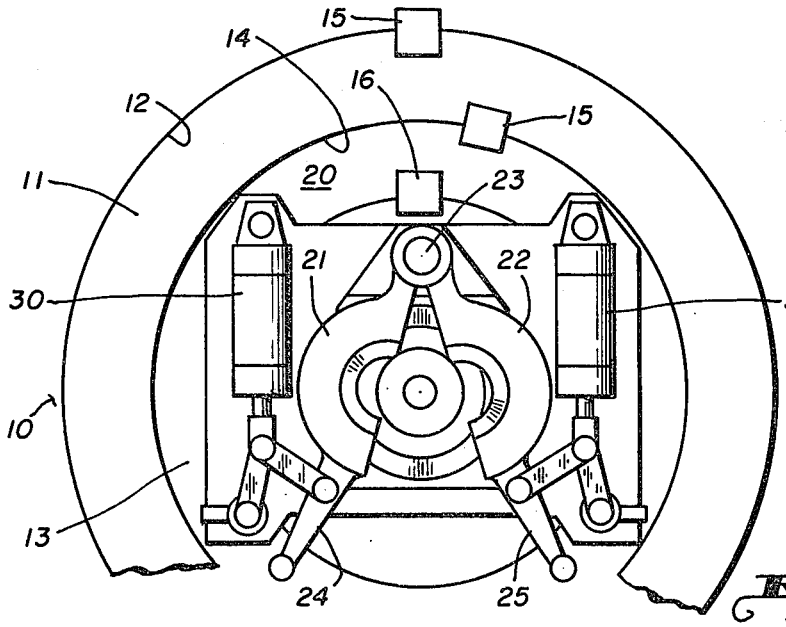
FIG. 2 is a sectioned plan view of the structure of FIG. 1.

The old rotary table evolved into standard diameter over the years. It may be that the standard aperture available in existing rig floors is too large to accommodate the structure upon which my novel spider is mounted. FIG. 2 discloses how the larger floor opening 10 may be provided with a support plate 11 with a central aperture, having an aperture 12 in which may be mounted a second plate 13, plate 13 being the direct mount for my new spider. Thus, my concept includes a plurality of concentlric plates of varying diameters which are stepped radially inward to provide a final mount for the embodiment of my invention. Thus we arrive at the final plate 13 which is shown in both FIG. 1 and FIG. 2 as the circular plate forming the mount for the novel spider.

To give some feel for the sizing involved in an actual reduction to practice and the apertures in the rotary table on which the spider is mounted, I point out that a 49½" diameter opening has been a larger of the standard sized openings. Through such opening, 48" casing can be lowered into the well bore. The next lower standard size opening in the rotary tables is 37½" through which 36" pipe can be lowered into the well bore. Finally, there is a 27½" standard size opening through which 26" pipe has been lowered into a well bore. Smaller standard size 20½" has been provided. Regardless of what size aperture is available, plates 11 and 13 represent the plurality of plates which can be provided the opening 12 on which the present embodiment is mounted.

As a unit spider 20 is mounted on plate 13. As seen perhaps most clearly in FIG. 2, spider 20 is comprised of a pair of jaw members which pivot at 23.

In FIG. 2, the spider jaws 21, 22 are pivoted to their open position. Drill string 6 can freely pass between the jaws during the drilling and tripping sequences.

FIG. 1 discloses how the spider jaws are shaped on their upper ends to accommodate the lower end of the box 7 of drill string 6. In FIG. 1 the jaws are parted sufficiently to appreciate their coming together beneath the box 7 to grip the drill string along the vertical length of its stand while the box 7 rests its shoulder on the upper surface of the spider jaws.

Each jaw 21, 22 is provided an extension with which the jaw can be manually gripped. Jaw 21 has handle 24 while jaw 22 has handle 25. However, it is an object of my invention to also provide automatically powered structure attached to move these jaws toward and away from each other.

Figure 3:
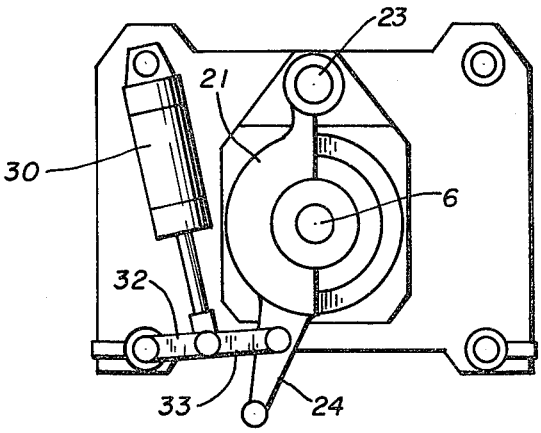
FIG. 3 is a sectioned plan view of a part of the structure of FIG. 2.

FIG. 2 discloses hydraulic pistons 30 and 31 connected to links through which to actuate the jaws between their two positions. FIG. 2 shows the piston 30 controlling the pair of links between handle 24 and the base. Piston 31 actuates a similar pair of links for jaw 22. In FIG. 2 the pistons are shown in their retracted positions to draw the spider jaws apart. FIG. 3 dicloses piston 30 extended to actuate the pair of links 32, 33 to move jaw 21 into engagement with drill string 6. It is not deemed necessary to illustrate either a source of supply of power fluid for the cylinders of the pistons 30, 31, nor the control for applying the supply to the cylinders at the desired time.

Plates 11, 13 are registered with each other and hole 12 in the plate 11 is placed over opening 10 to register its hole 12 in concentricity. Plate 13 is then registered on plate 11 to form its hole 14 concentric with hole 12. Tabs 15 on plate 11 and tabs 16 on plate 13 may be engaged with suitable indentations or pins to maintain registration on their supporting surfaces. Finally, spider 20 is mounted on plate 13 with suitable indexing pins, not shown, to insure the stability of the spider on its mount and the consistency of the directional opening of the jaws.

CONCLUSION

As a structure for manually, or automatically, gripping The depending drill string, the present invention slides into the prior art without causing any basic reorientation of the conventional structure used in association. The new spider is simply mounted above the location of the old slip bowl to introduce an improved means with which to grip and release the drill string at the proper location and at the suitable time within the cycle of drilling and tripping sequences. Any mud-stripping bushings at the slip bowl can perform their function of cleaning the pipe as it is tripped out of the well while the new spider functions. However, no longer is there need to dangerously place slip structures into their bowl, and remove them, by hand. The structure embodied in the present invention is remotely actuated by personnel in safe locations. Even if the automatic system fails, lengthy levers are attached to the jaws 21, 22 which are manually manipulated with comparative safety by personnel. Thus, the present invention provides still another one of my family of improvements to the drilling art.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. A spider with which to grip and suspend a drill string within a well bore at predetermined times within the drilling and tripping sequences, including, a drilling floor extending horizontally and over the well bore having an aperture concentric with the well bore, a plurality of plate structures mounted over the floor aperture and having apertures of progressive sizes oriented concentric with the floor aperture and each other's apertures, tab structures mounted at the edges of the plates to support and register the plates to maintain the concentricity of the plate and floor apertures, a pair of jaws mounted to pivot on one of the upper plates and sized and arranged to have two positions which permit drill pipe to freely pass into and out of the well bore and alternatively grip the drill pipe at predetermined longitudinal locations as required to suspend the pipe during drilling and tripping sequences, linkages connected between the pivoted jaws and the upper plate to actuate the jaws between their two positions, hydraulic piston-cylinder structures mounted on the upper plate with their pistons connected to the linkages, and means for applying hydraulic fluid to the cylinders to move the pistons in their actuation of the jaws.

* * * * *